United States Patent [19]

Matson, Sr.

[11] Patent Number: 4,466,268

[45] Date of Patent: Aug. 21, 1984

[54] APPARATUS FOR STRAIGHTENING VEHICLE

[76] Inventor: Robert P. Matson, Sr., Rte. 9, Box 592B, Durkee Rd., Cleveland, Tenn. 37311

[21] Appl. No.: 358,713

[22] Filed: Mar. 16, 1982

[51] Int. Cl.[3] ..... B21D 1/12

[52] U.S. Cl. ..... 72/389; 72/458; 72/705

[58] Field of Search ..... 72/389, 390, 458, 705

[56] References Cited

U.S. PATENT DOCUMENTS

| | | | |
|---|---|---|---|
| 1,497,107 | 6/1924 | Lasell | 72/390 |
| 2,939,507 | 6/1960 | Miller | 72/705 |
| 3,319,455 | 5/1967 | Armstrong, Sr. | 72/705 |
| 3,927,556 | 12/1975 | Samuelsson | 72/705 |
| 3,981,173 | 9/1976 | Nobinger | 72/389 |
| 4,088,002 | 5/1978 | Andrew | 72/705 |
| 4,252,008 | 2/1981 | Dibbens | 72/705 |
| 4,257,255 | 3/1981 | Sanchez | 72/705 |
| 4,400,968 | 8/1983 | Barbieri | 72/705 |

*Primary Examiner*—Lowell A. Larson
*Attorney, Agent, or Firm*—B. J. Powell

[57] ABSTRACT

A straightening apparatus for use in straightening the bent portions of vehicles including a support frame in which the vehicle is positionable; a pusher unit adjustably mounted on the support frame and adapted to engage the bent portion of the vehicle and applying a straightening force thereto in a first direction; and a backup unit adjustably mounted on the support frame and adapted to engage the vehicle in the vicinity of and in opposition to the pusher unit and apply backup forces to the vehicle oriented generally parallel to the straightening force and in a second direction opposite to the first direction so that the bent portion of the vehicle can be straightened back to its original shape without deformation of the unbent portions of the vehicle.

7 Claims, 13 Drawing Figures

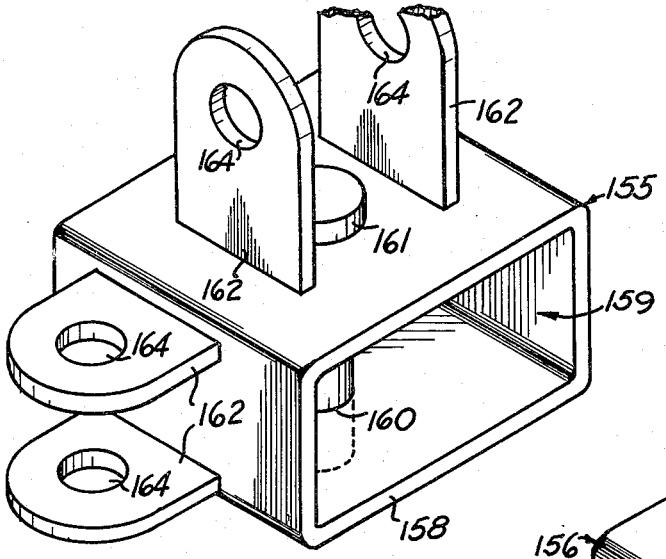
FIG 11
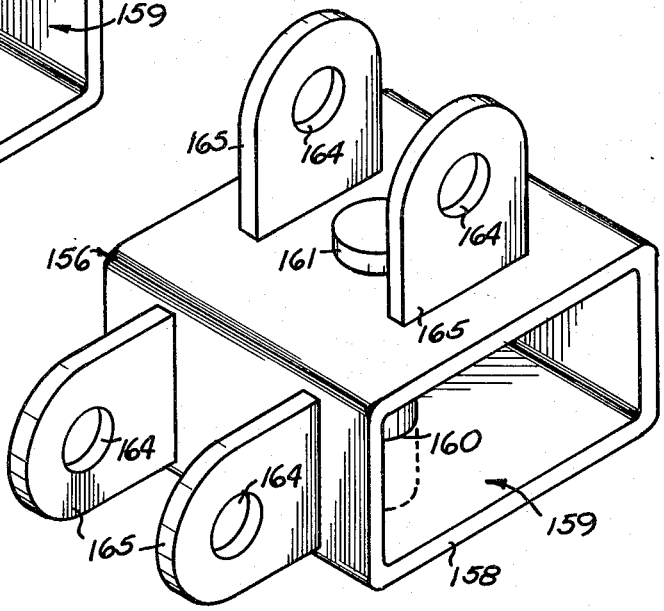
FIG 12
FIG 13
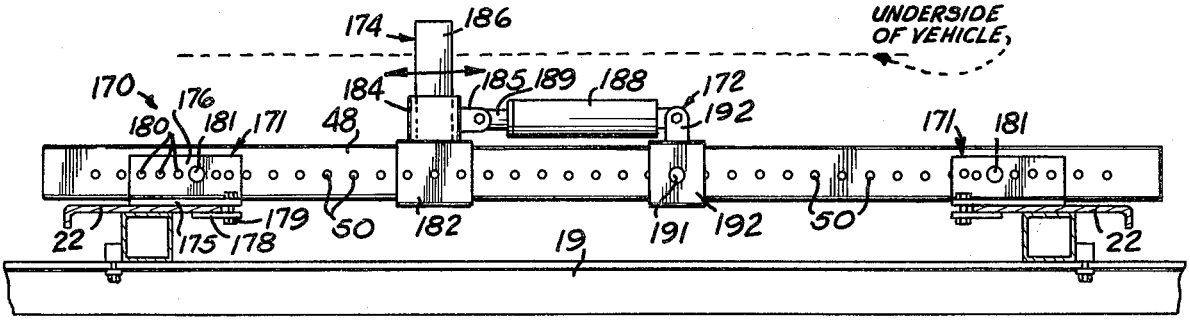

APPARATUS FOR STRAIGHTENING VEHICLE

BACKGROUND OF THE INVENTION

This invention relates generally to vehicle repair equipment and more particularly to a machine for straightening the body and frame of a vehicle.

Numerous frame and body straightening equipment is available on the market today. These machines typically suffer from two basic drawbacks. The first is that the machines are usually not sufficiently adjustable to allow the machine to straighten the wide range of body and frame parts required to be straightened. As a result, using prior art frame and body straightening machines required extensive manual straightening operations to supplement the machine performed straightening operations in order to produce a satisfactory vehicle repair operation or required the extensive use of new body parts rather than the straightening and repair of these damaged body parts. The other basic drawback associated with these prior art body and frame straightening machines is that, while one force is applied to the bent section of the frame or body part, the opposing force to hold the vehicle in position are generally applied at positions remote from the bent portions of the body or frame of the vehicle. As a result, use of these prior art body and frame straightening devices frequently resulted in damage to the originally undamaged portion of the vehicle thereby greatly hampering the repair operation.

SUMMARY OF THE INVENTION

These and other problems and disadvantages associated with the prior art are overcome by the invention disclosed herein by the provision of a body and frame straightening machine which has sufficient flexibility to provide access to virtually all of the damaged portions of a vehicle so that virtually all of the damaged portions of the vehicle can be straightened using the machine. Also, the invention provides for the straightening of the bent portions of the vehicle frame or body while maintaining the original position of the undamaged portions of the frame or body so that these undamaged portions are not damaged as a result of the body straightening operation.

The apparatus of the invention includes an open support frame which adjustably mounts a pair of support tracks thereon so that the vehicle can be supported within the confines of the support frame on the support tracks. Primary support beams are adjustably supported on the support frame so that they are movable to different positions on the support frame. Any desired number of primary support beams can be used for any body or frame straightening operation. Additionally, auxiliary support beams can be selectively connected to the primary support beams to provide further positioning of the body straightening units with respect to the vehicle.

The straightening unit includes a pusher unit which can be adjustably supported on the primary and/or auxiliary support beams to apply forces against a bent portion of the vehicle body or frame to straighten it. The straightening unit also includes a backup unit which is positioned on the vehicle in opposition to the pusher unit to hold the undamaged portions of the vehicle body or frame in position while the pusher unit straightens the bent portion of the body or frame. By using a combination of the pusher unit and the backup unit, any portion of the vehicle body or frame can be straightened in a controlled manner which permits the bent portion of the vehicle body or frame to be straightened without affecting the undamaged portion of the body or frame. Both the pusher unit and the backup unit are adjustable so that access to virtually any portion of the body or frame can be achieved for straightening.

These and other features and advantages of the invention will become more apparent upon consideration of the following description and accompanying drawings wherein like characters of reference designate corresponding parts throughout the several views and in which:

BRIEF DESCRIPTION OF THE DRAWINGS

FIG. 11 is an enlarged perspective view illustrating a first type beam collar for use with a conventional straightening attachment;

FIG. 12 is an enlarged perspective view illustrating a second type beam collar for use with a conventional straightening attachment; and FIG. 13 is an enlarged view illustrating a straightening assembly for underbody work.

Figure 1:
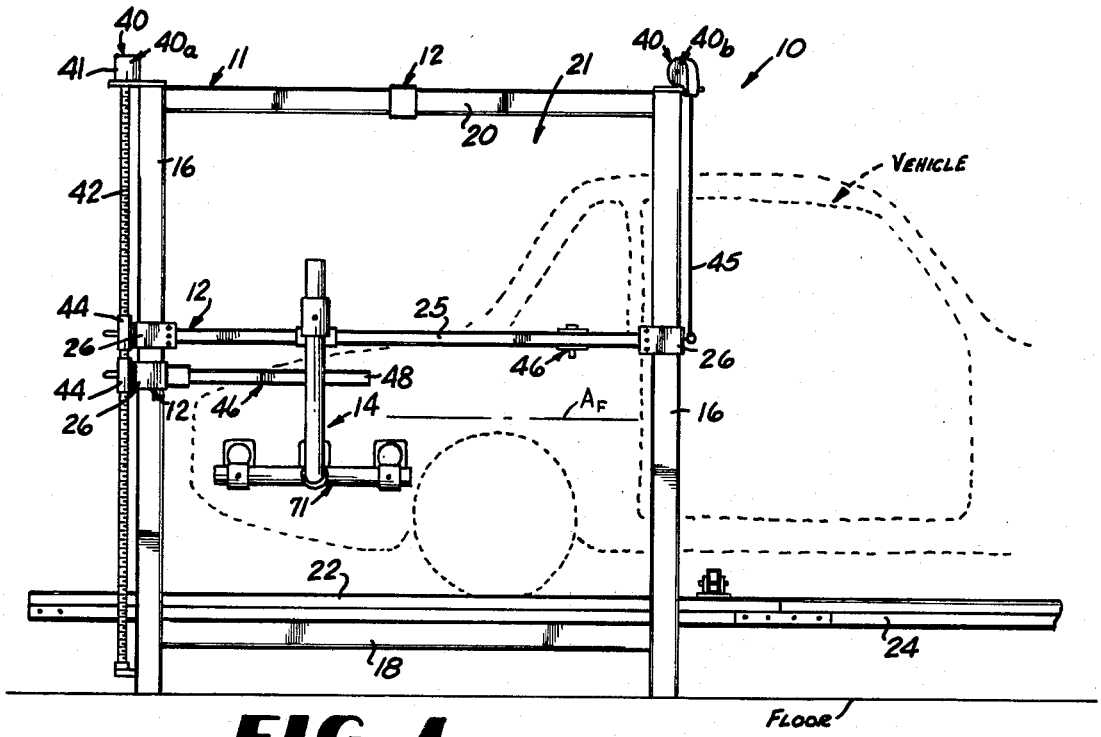
FIG. 1 is a side elevational view of the invention.

These figures and the following detailed description disclose specific embodiments of the invention; however, it is to be understood that the inventive concept is not limited thereto since it may be embodied in other forms.

DETAILED DESCRIPTION OF ILLUSTRATIVE EMBODIMENTS

Referring to the figures, it will be seen that the straightening machine 10 incorporating the invention includes generally a support frame 11 which movably mounts a plurality of primary support beams 12 on which are adjustably mounted one or more straightening units 14 so that when a vehicle is positioned on the support frame 11, the straightening units 14 can be used to straighten the vehicle body and frame.

The support frame 11 includes four vertical corner posts 16 which set on the floor. The posts 16 are fixedly connected adjacent their lower ends by a pair of side rails 18 along opposite sides of the frame 11 and a pair of end rails 19 along opposite ends of frame 11. The tops of the posts 16 are fixedly connected by top rails 20 so that the support frame 11 is an open rectilinear framework defining working space 21 therein with longitudinal axis $A_F$. Both the posts 16 and top rails 20 have a square cross-sectional shape of the same size as will become more apparent.

A pair of support tracks 22 are mounted on top of the end rails 19 and extend longitudinally through the support frame 11 to support the tires of the vehicle thereon. The support tracks 22 are adjustably connected to the end rails 19 so that the lateral spacing of the support tracks 22 can be adjusted to accommodate vehicles with different wheel widths. Track extensions 24 are provided which can be selectively connected to opposite ends of the tracks 22 to provide support for that portion of the vehicle extending out of the support frame 11 past the ends of the support tracks 22. The support tracks 22 serve to locate the vehicle at a convenient working height in the working space 21 in frame 11.

The primary support beam assemblies 12 have two different lengths so that one size can be movably mounted between the posts 16 to extend along the sides of the support frame 11 while the other size can be mounted on the posts 16 to extend across the ends of the frame 11. It will also be appreciated that each size beam assembly 12 can be mounted between the top rails 20 to extend longitudinally or transversely of the top of frame 11 over the working space 21.

Each primary support beam assembly 12 includes an elongate support beam 25 provided with a pair of cuff assemblies 26 on opposite ends thereof. The elongate support beam 25 has a rectilinear cross-sectional shape and a length corresponding to the distance between the corner posts 16 with which it is to be used. Beam 25 has a major transverse width in one direction about equal to the width of the posts 16 and top rails 20 and a minor transverse width in the other direction of about one-half the width of posts 16 and top rails 20. Typically, the posts 16 and top rails 20 are about 4×4 inches while beams 25 are 2×4 inches. Thus, when beam 25 is horizontally oriented between the posts 16, opposite ends of the beam 25 are located adjacent the posts.

Figure 4:
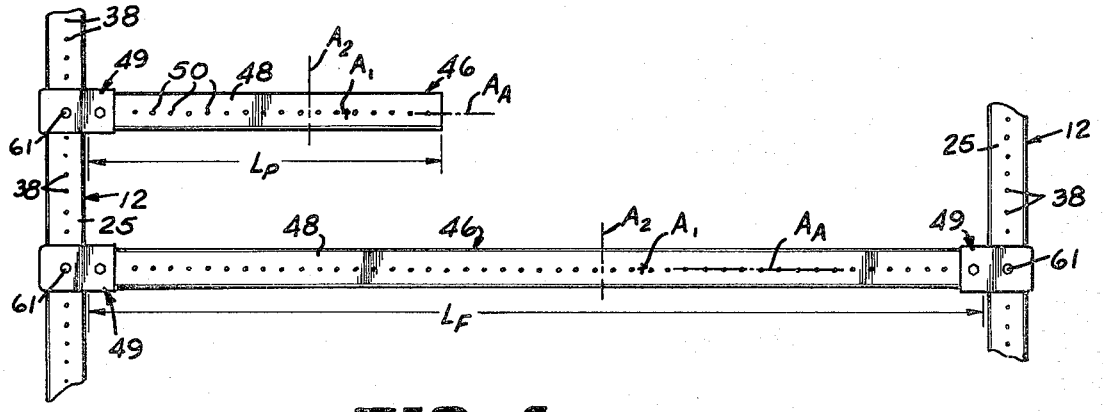
FIG. 4 is a plan view illustrating the auxiliary support beam assemblies of the invention.

Each end of beam 25 has a pair of spacer tubes 28 seen in FIG. 4 attached thereto on opposite sides thereof to build the minor width of the end of beam 25 up to the major width thereof so that the ends of the beam have a square configuration. This allows the beam 25 to be connected to the cuff assemblies 26 with the minor transverse axis $A_1$ of beam 25 located vertically or with the major transverse axis $A_2$ located vertically.

Each cuff assembly 26 includes a U-shaped clamping member 30 sized to fit around three sides of the post 16 so that the projecting ends of the legs 31 thereof overlap the end of beam 25 to be connected to post 16. The projecting ends of the legs 31 are provided with three pairs of aligned holes 32. When the minor transverse axis $A_1$ of beam 25 is oriented vertically, the holes 32 are in registration with the passages through the space tubes 28 and an attachment hole 34 through the end of beam 25 normal to the minor axis $A_1$. When the major transverse axis $A_2$ of beam 25 is oriented vertically, the holes 31 align with three attachment holes 35 extending through the spacer tubes 28 and the end of beams 25. This is best seen in FIG. 4. Three attachment bolts 36 are provided to extend through the holes 31 in clamping member 30 and the passages and/or holes in the end of beam 25. When bolts 36 are tightened, they clamp the clamping member 30 around post 16 to selectively fix the beam assembly 12 to the post 16 at any selected vertical position. When the bolts 36 are loosened, the clamping member 30 is released sufficiently for the beam assembly 12 to be slidably moved along the posts 16. Since the top rails 20 are the same size as the posts 16, the cuff assemblies 26 can be used to mount the support beam assemblies 12 therebetween.

Each of the support beams 25 is provided with a plurality of locating holes 38 therethrough as seen in FIG. 4 for use in locating components on the beams 25 as will become more apparent. The holes 38 are oriented normal to the major transverse axis $A_2$ of the beam and centered across the width of the beam 25. The holes 38 are also equally spaced from each other along the length of the beam 25.

To position the support beam assemblies 12 vertically along the corner posts 16, a positioning assembly 40 is provided at the top of each of the corner posts 16 to selectively engage opposite ends of the support beam assemblies 12. Two forms of the positioning assemblies 40 are illustrated; however, it is to be understood that the same type positioning assemblies 40 would normally be used on all of the corner posts 16 with the two types being shown on the different corner posts 16 simply for the sake of illustration.

The first type of positioning assembly designated $40_a$ is illustrated on the posts at the left end of the support frame 11 in FIG. 1 while the other type of positioning assembly designated $40_b$ is illustrated on the posts 16 at the opposite end of the support frame 11 in FIG. 1. The positioning assembly $40_a$ is a powered positioning assembly and includes a drive motor 41 mounted on the top of the corner posts 16 which rotates a drive screw 42 extending along the length of the corner posts 16 parallel thereto at its outside corner. The drive screw 42 extends past the cuff assemblies 26 of the support beam assemblies 12 slidably mounted on the post 16 and each of the cuff assemblies 26 is provided with a releasable split nut unit 44 so that the split nut unit 44 can be selectively engaged with a drive screw 42 to cause the drive screw 42 to shift the cuff assembly 26 and thus one end of the support beam assembly 12 vertically along the posts 16. It will thus be seen that the split nut units 44 on the cuff assemblies 26 at the opposite ends of each support beam assembly 12 will be engaged with the drive screw 44 when it is desirable to move the support beam assembly 12 vertically along posts 16. When the support beam assembly 12 is located at the desired vertical position on the posts 16, the attachment bolts 37 thereon are tightened and the split nut units 44 thereon are released from the drive screw 44 so that the support beam assembly is held in the desired vertical position.

The positioning assemblies $40_b$ are shown on the right end of the support frame 11 in FIG. 1 and have a cable 45 which extends from the positioning assembly $40_b$ for engagement with an appropriate attachment on the cuff assembly 26 of the support beam assembly 12. The cables 40 on the positioning assemblies $40_b$ are spring-loaded to counterbalance the weight of the support beam assembly 12 connected thereto so that the support beam assembly can be easily manually moved vertically along the corner posts 16. When the support beam assembly is located at the desired vertical position along the posts 16, the attachment bolts 36 are tightened to clamp the support beam assembly 12 to the corner posts 16 and maintain it at the desired vertical position.

Auxiliary support assemblies 46 are also provided to be adjustably mounted on the primary support beam assemblies 12. The auxiliary support assemblies 46 can be used to mount the straightening units 14 thereon to provide greater flexibility in locating the straightening units 14 within the working space 21 as will become more apparent. Some of the auxiliary support assemblies 46 are designed to be mounted on a single primary support beam 25 while other of the support assemblies 46 are designed to extend between a pair of opposed primary support beams 25.

Figure 5:
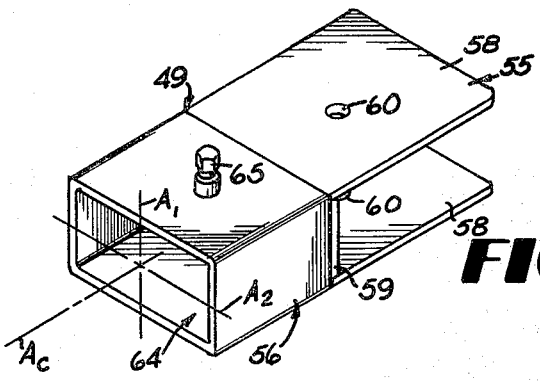
FIG. 5 is an enlarged perspective view illustrating a first type clevis assembly for the auxiliary beam assembly.

Each auxiliary support assembly 46 as seen in FIG. 5 includes an auxiliary support beam 48 and one or more mounting clevis assemblies 49. Each auxiliary support beam 48 has a rectilinear cross-sectional size and shape corresponding to that of the primary support beams 25 with a minor transverse axis $A_1$ and a major transverse axis $A_2$. Each beam 48 is also provided with a plurality of locating holes 50 therethrough oriented normal to the major transverse axis $A_2$ corresponding to the holes 38 through beams 25. The locating holes 50 are also equally spaced apart along the beam 48 on the same spacing as holes 38 through beams 25. Some of the auxiliary support beams 48 have a length $L_p$ such that they extend only part of the way across the working space 21 while other of the beams 48 have a length $L_F$ such that they extend the full distance across the working space 21 as will become more apparent.

Each mounting clevis assembly 49 includes a beam mounting subassembly 55 for attaching the clevis assembly 49 on one of the primary support beams 25 and a pocket subassembly 56 for attaching one of the auxiliary support beams 48 to the clevis assembly 49.

The beam mounting subassembly 55 includes a pair of spaced apart mounting plates 58 adapted to span the minor width of the primary support beam 25 so that the plates 58 overlie the locating holes 38 in the primary support beam 25. An abutment member 59 extends between plates 58 and is adapted to engage the side of the primary support beam 25 to keep the longitudinal axis $A_C$ of the clevis assembly 49 normal to the longitudinal axis $A_B$ of the support beam 25. A pair of aligned mounting holes 60 are provided through the mounting plates 58 which are registerable with the locating holes 38 through the support beam 25 when the plates 58 extend over opposite sides of the beam 25 and the abutment member engages the side of beam 25. A locking pin 61 is provided to slidably extend through the mounting holes 60 in subassembly 55 and locating holes 38 in beam 25 in registration with holes 60 to fixedly yet releasably attach the clevis assembly 49 to the support beam 25. When the pin 61 is extending through the holes 60 and 38, the clevis assembly is locked onto beam 25 with abutment member 59 maintaining the axis $A_C$ of clevis assembly 49 normal to the axis $A_B$ of beam 25.

Figure 6:
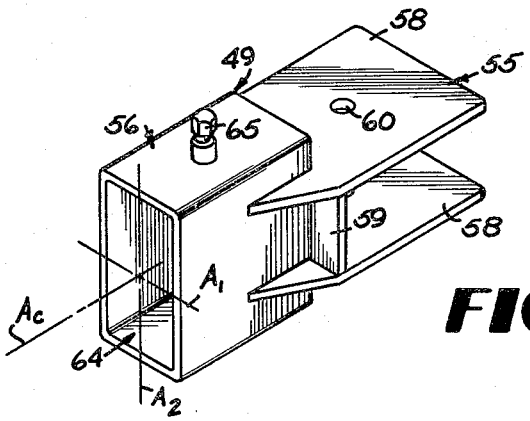
FIG. 6 is an enlarged perspective view illustrating another type of clevis assembly for the auxiliary beam assembly.
Figure 7:
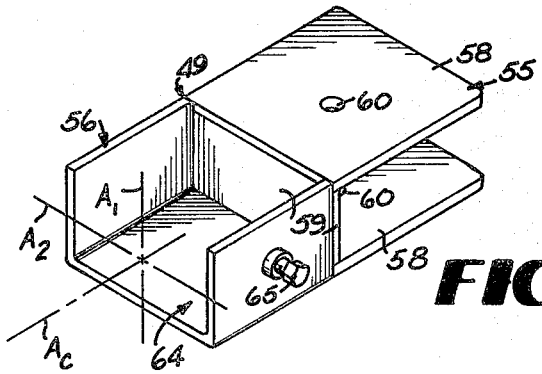
FIG. 7 is an enlarged perspective view illustrating another type of clevis assembly for the auxiliary beam assembly.

The pocket subassembly 56 is attached to the end of the beam mounting subassembly 55 at the abutment member 59 so that the pocket subassembly 56 projects outwardly from the mounting subassembly 55 along the clevis axis $A_C$ and in opposition to the space between the mounting plates 58. The pocket subassembly 56 defines a pocket 64 therein which opens onto that end of the subassembly 56 in opposition to the space between the plates 58. The pocket 64 is oriented along axis $A_C$ and has a cross-sectional size and shape complementary to that of the auxiliary support beams 48 so that the end of one of the beams 48 can be just slidably received therein. Sometimes it is desirable to mount the auxiliary beam 48 in pocket 64 so that its minor transverse axis $A_1$ is normal to the axis $A_B$ of primary support beam 25 and sometimes so that its major transverse axis $A_2$ is normal to the axis $A_B$ of primary support beam 25. Thus, in some of the clevis assemblies 46 as seen in FIG. 6, the pocket subassembly 56 is attached to the mounting subassembly 55 so that the minor transverse axis $A_1$ of pocket 64 is vertical when the clevis assembly 49 is mounted on primary support beam 25. In other of the clevis assemblies 46 as seen in FIG. 7, the pocket subassembly 56 is attached to the mounting subassembly 55 so that the major transverse axis $A_2$ of pocket 64 is vertical when the clevis assembly 49 is mounted on primary support beam 25. When the auxiliary support beam 48 is fitted in pocket 64, the axis $A_A$ of beam 48 is co-planar with the axis $A_B$ of the primary support beam 25 and perpendicular to axis $A_B$. A locking bolt 65 is provided on pocket subassembly 56 to retain the auxiliary support beam 48 in pocket 64.

Thus, the shorter length auxiliary support beams 48 will be supported from one end in one clevis assembly 49 and project therefrom into the working space 21. The longer length auxiliary support beams 48 will be supported at opposite ends between a pair of clevis assemblies 48 mounted on opposed primary support beams 25. One side of the pocket 64 in the pocket subassembly 56 of the clevis assemblies 49 used with the longer length beams 48 may be left open as seen in FIG. 8 to facilitate the fitting of these auxiliary support assemblies 46 between the opposed primary support beams 25.

Figure 8:
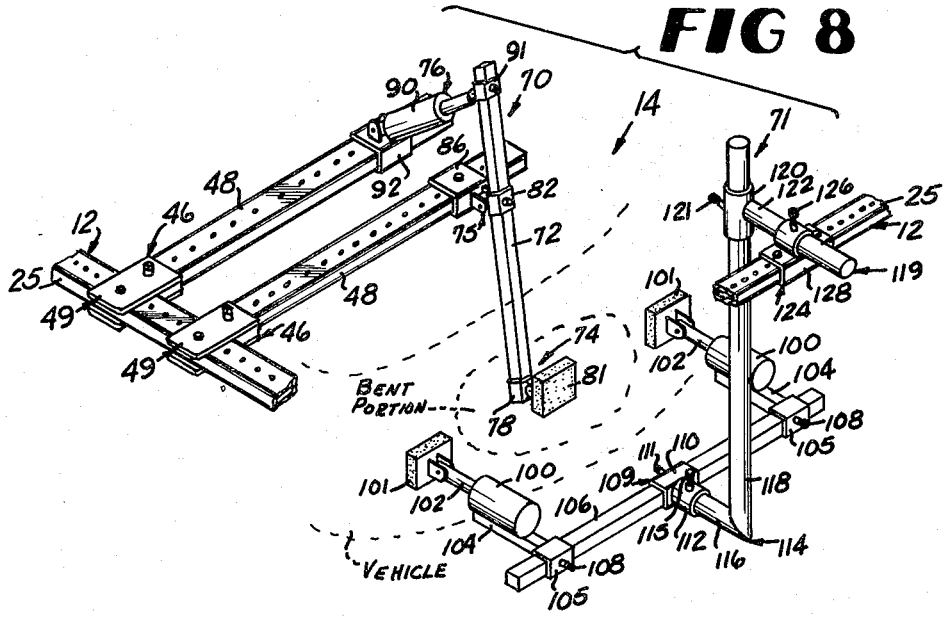
FIG. 8 is an enlarged perspective view illustrating the straightening unit of the invention.
Figure 9:
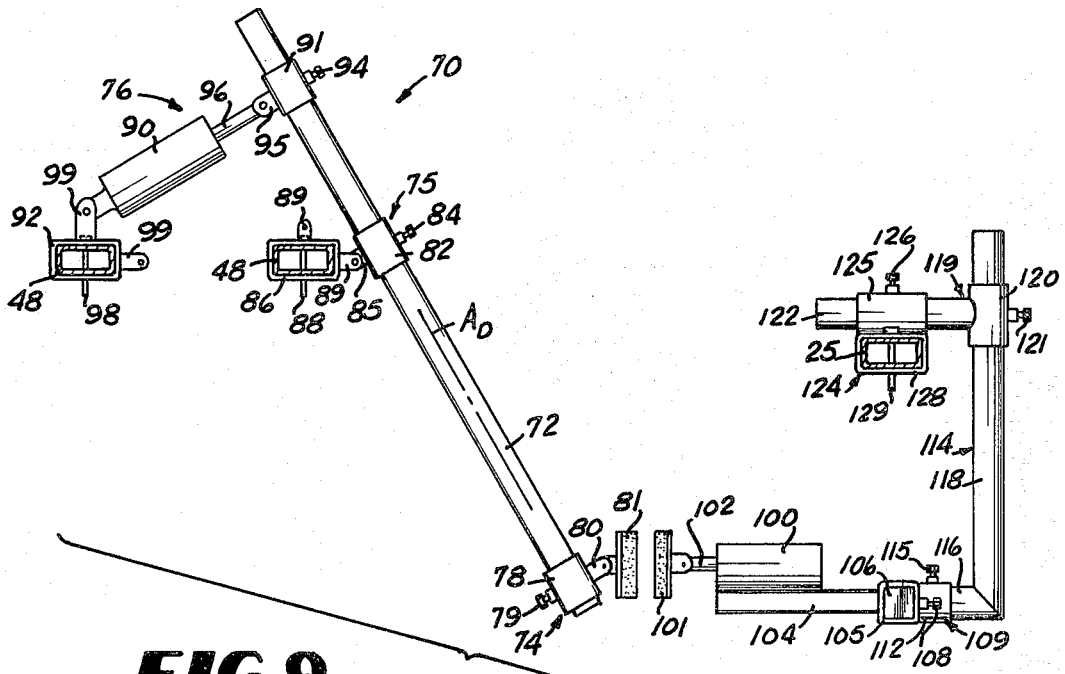
FIG. 9 is an enlarged side elevational view of the straightening unit of the invention.

Each of the straightening units 14 includes a pusher unit 70 and a backup unit 71 as best seen in FIGS. 8 and 9. While any number of straightening units 14 may be provided, only one such straightening unit is illustrated. The pusher unit 70 and backup unit 71 cooperate to straighten the bent portions of the vehicle in a controlled manner so that the unbent portions of the vehicle will not be inadvertently bent as a result of the straightening operation.

The pusher unit 70 includes an elongate drive arm 72 which mounts a working pad assembly 74 thereon to engage the vehicle. The drive arm 72 is pivotally mounted in a pivot assembly 75 so that the drive arm 72 can be pivoted to engage the working pad assembly with the vehicle. A drive assembly 76 is connected to the drive arm 72 to pivot same. The drive arm 72 has a rectilinear cross-sectional shape and an appropriate length to allow the drive arm to extend into the various areas of the vehicle to be straightened as will become apparent.

The working pad assembly 74 includes a mounting collar 78 defining a passage therethrough sized to slidably receive the drive arm 72 therethrough. A locking bolt 79 is provided on collar 78 to selectively lock collar 78 onto the drive arm 72 at any desired position along its length. The collar 78 is also provided with pivot ears 80 that pivotally mount a working pad 81 thereon to allow the working pad 81 to pivot about a pad pivot axis normal to the longitudinal axis $A_D$ of drive arm 72. It will be appreciated that a number of different working pads 81 will be used having different configurations to conform to the particular portion of the vehicle being repaired.

The pivot assembly 75 includes an arm collar 82 defining a passage therethrough sized to slidably receive the drive arm 72. A locking bolt 84 is provided on collar 82 to selectively lock the collar 82 onto the drive arm 72 at any desired position along its length. The collar 82 is also provided with a pivot ear 85 on the side thereof. The pivot assembly 75 also includes a beam collar 86 defining a passage therethrough sized to slidably receive one of the auxiliary support beams 48 or one of the primary support beams 25. The beam collar 86 is provided with a pair of aligned locking holes therethrough which can be moved into registration with the locating holes 50 when the beam collar 86 is mounted on one of the support beams 48 or with the locating holes 38 when the beam collar 86 is mounted on one of the primary support beams 25. A locking pin 88 is provided to be received through the locking holes in the beam collar 86 and the locating holes 50 or 38 in registration therewith to lock the beam collar 86 in position on the support beam 48 or 25 mounting the beam collar 86. The beam collar 86 is also provided with two sets of pivot ears 89 which can be selectively pivoted to the pivot ear 85 on the arm collar 82 so that the collars 82 and 86 can pivot with respect to each other about a pivot axis normal to the drive arm axis $A_D$ and parallel to the axis of the beam mounting the pivot assembly 75.

The drive assembly 76 includes a drive cylinder 90, an arm collar 91 and a beam collar 92. The arm collar 91 defines a passage therethrough sized to slidably receive the drive arm 72 and is provided with a locking bolt 94 to selectively lock the arm collar 91 onto the drive arm 72 at any desired position along its length. The arm collar 91 is provided with a pair of pivot ears 95 which are pivotally connected to the projecting end of the piston rod 96 of the drive cylinder 90 so that the piston rod 96 can pivot with respect to the arm collar 91 about a pivot axis normal to the drive arm axis $A_D$. The beam collar 92 defines a passage therethrough sized to slidably receive one of the auxiliary support beams 48 or one of the primary support beams 25 therethrough. The beam collar 92 is provided with a pair of aligned locking holes therethrough which are selectively registerable with the locating holes 50 when the beam collar 92 is mounted on an auxiliary support beam 48 or with the locating holes 38 when the beam collar is mounted on one of the primary support beams 25. A locking pin 98 is provided to extend through the locking holes in the beam collar 92 and the locating holes 50 or 38 in registration therewith to selectively lock the beam collar 92 in position along the auxiliary support beam 48 or the primary support beam 25 mounting same. The beam collar 92 is provided with a plurality of sets of pivot ears 99 on different sides thereof adapted to be pivotally connected to the closed end of the drive cylinder 90 so that the closed end of the cylinder is pivotally mounted on the support beam 48 or 25 about a pivot axis parallel to the support beam axis.

Figure 10:
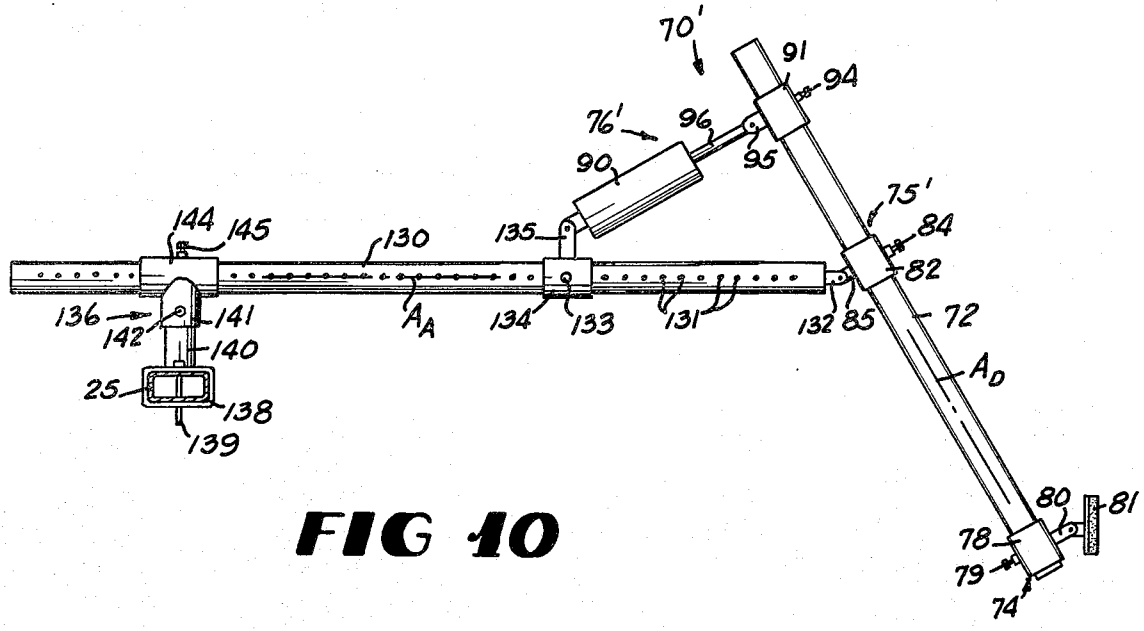
FIG. 10 is an enlarged side elevational view illustrating a second embodiment of the pusher unit of the invention.

The pusher unit 70 is assembled so that the pivot axes of the working pad assembly 74, pivot assembly 75, and drive assembly 76 are parallel to each other. Typically, the pivot assembly 75 and drive assembly 76 are supported from a pair of the auxiliary support assemblies 46 as seen in FIGS. 9 and 10 with the beam collars 86 and 92 thereof aligned with each other in vertical registration with the bent portion of the vehicle to be straightened. The working pad assembly 74 is typically mounted on one end of the drive arm 72 and the drive arm 72 adjustably positioned in the pivot assembly 75 until the working pad 81 in the working pad assembly 74 is in registration with the bent portion of the vehicle to be straightened. The drive arm 72 is locked into position in the pivot assembly 75 so that the working pad 81 on the working pad assembly 74 can push against the bent portion of the vehicle as the drive arm 72 is pivoted about the pivot axis in the pivot assembly 75. The drive assembly 76 is adjustably mounted on the drive arm 72 until the axis of the drive cylinder 90 is generally normal to the axis of the drive arm 72 and the drive assembly 76 locked onto the drive arm 72. It will thus be seen that the drive arm 72 will be pivoted about the pivot axis in the pivot assembly 75 as the piston rod 96 of drive cylinder 90 is selectively extended and retracted to cause the working pad 81 in the working pad assembly 74 to engage the bent portion of the vehicle to straighten same. The wide range of adjustability provided in the pusher unit 70 allows the working pad 81 to be positioned at virtually any portion of the vehicle to be straightened.

The backup unit 71 includes a pair of backup cylinders 100, each of which has a backup pad 101 pivotally mounted on the projecting end of its piston rod 102. It will be appreciated that a number of different backup pads 101 will be used having different configurations to conform to the particular portions of the vehicle being supported by the backup pads 101. Each of the backup cylinders 100 is mounted on a support tube 104 so that the piston rod 102 thereof projects beyond the end of the support tube 104. The opposite end of the support tube 104 is provided with support collar 105 defining a passage therethrough to be slidably received over a cross tube 106 with a rectilinear configuration. Each of the support collars 105 is provided with a locking bolt 108 to selectively lock the support collar 105 in position along the length of the cross tube 106. Thus, it will be seen that the support collars 105 adjustably position both of the backup cylinders 100 on the cross tube 106.

A cross collar assembly 109 is mounted on the cross tube 106 between the support collars 105 for use in positioning the cross tube 106. The cross collar assembly has a cross collar 110 which defines a passage therethrough slidably receiving the cross tube 106 so that the cross collar 110 can be slidably moved along the length of the cross tube 106. The cross collar 110 is provided with a locking bolt 111 to selectively lock the cross collar 110 in position along the length of the cross tube 106. The cross collar assembly 109 also includes a mounting collar 112 fixed to the cross collar 110 so that the axis of the mounting collar 112 is perpendicular to the axis of the cross collar 110. The mounting collar 112 defines a passage therein with a circular cross-sectional shape to rotatably receive the end of a positioning tube assembly 114 therein. The mounting collar 112 is provided with a locking bolt 115 to selectively lock the mounting collar 112 in position on positioning tube assembly 114 as will become more apparent.

The positioning tube assembly 114 is an L-shaped member with a short positioning tube 116 and a long positioning tube 118 attached together at one of their ends so that the short positioning tube 116 is perpendicular to the long positioning tube 118. The projecting end of the short positioning tube 116 is rotatably received in the mounting collar 112 so that the locking bolt 115 can be adjusted to lock the cross collar assembly 109 onto the short positioning tube 116 so that the axis of the cross collar 110 can be positioned at any rotational position with respect to the axis of the short positioning tube 116. The long positioning tube 118 is adjustably mounted in a support assembly 119.

The support assembly 119 includes support collar 120 defining a passage therethrough sized to slidably and rotatably receive the long positioning tube 118 therethrough. The support collar 120 is provided with a locking bolt 121 so that the support collar 120 can be fixed to the long positioning tube 118 at any position along its length and the positioning tube 118 can be located with respect to the support collar 120 at any rotational position about its axis. The support assembly 119 also includes a support tube 122 fixedly attached to the support collar 120 and extending outwardly therefrom normal to the axis of the support collar 120. The support tube 122 is positioned in a locating collar assembly 124 adjustably mounted on one of the primary support beams 25 or the auxiliary support beams 48.

The locating collar assembly 124 includes a tube collar 125 defining a passage therethrough sized to slidably and rotatably receive the support tube 122. The tube collar 125 is provided with a locking bolt 126 to selectively lock the support tube 122 in the tube collar 125 at any position axially of the support tube 122 and at any desired rotational position of the support tube 122 with respect to the tube collar 125. The locating collar assembly 124 also includes a beam collar 128 affixed to the tube collar 125 and defining a passage therethrough sized to slidably receive either a primary support beam 25 or an auxiliary support beam 48 therethrough. The beam collar 128 is oriented so that the axis of collar 128 is perpendicular to the axis of tube collar 125. Beam collar 128 is provided with two pairs of aligned locating holes therethrough which can be placed in registration with the locating holes 50 when the beam collar 128 is mounted on an auxiliary support beam 48 or the holes 38 when the beam collar 128 is mounted on one of the primary support beams 25. Locking pins 129 are provided to extend through the locking holes in the beam collar 128 and the holes 50 or 38 in registration therewith to selectively lock the beam collar 128 at any desired position along the length of the support beam 25 or 48 mounting the beam collar 128.

The backup pads 101 on the backup unit 71 are designed to engage the vehicle in opposition to the working pad 81 of the pusher unit 70 so that the bending of a particular portion of a vehicle to straighten same by the pusher unit 70 is not inadvertently transmitted to those portions of the vehicle away from that portion of the vehicle being straightened by the pusher unit 70. The backup unit 71 is adjusted so that the working pads 101 are in alignment with the working pad 81 of the pusher unit 70 but spaced outwardly thereof to engage those portions of the vehicle adjacent the bent portion of the vehicle being straightened by the working pad 81. The various adjustments incorporated in the backup unit 71 provide sufficient flexibility to allow desired positioning of the working pads 101 to be achieved at virtually any portion of the vehicle. It will further be appreciated that the backup unit 71 may be used with any number of backup cylinders 100 and backup pads 101 to confine the bending of that portion of the vehicle by the pusher unit 70 to any desired location. In some instances, it will also be appreciated that only one of the backup cylinders 100 and backup pads 101 may be needed to provide the desired backup for the working pad 81 on the pusher unit 70. It will also be appreciated that the positioning tubes 116 and 118 and the support tube 122 all have the same cross-sectional size so that positioning tube assembly 114 may be mounted directly in the locating collar assembly 124 or the cross collar assembly 109 may be mounted directly on the support tube 122 to provide additional flexibility in the mounting of the backup unit 71.

After the pusher unit 70 and backup unit 71 are positioned on opposite sides of that portion of the vehicle to be straightened, the backup cylinders 100 are extended until the backup pads 101 support the vehicle adjacent the bent portion to be straightened. The drive cylinder 90 in the pusher unit 70 is then used to pivot drive arm 72 and cause the working pad 81 thereon to engage the bent portion of the vehicle and straighten same. The backup pads 101 provide fixed points on the vehicle for the working pad 81 to work against so that the bending forces applied by the pusher unit 70 do not inadvertently bend the vehicle except in the area desired.

It will also be appreciated that it is sometimes desirable to mount the drive unit 70 on a single support beam. FIG. 10 illustrates such a mounting with the pusher unit referenced as 70'. Those components of the pusher unit 70' common to the pusher unit 70 have the same reference numerals applied thereto.

The pivot assembly 75' includes an elongate support tube 130 in lieu of beam collar 86 and is provided with pivot ears 132 on the end thereof which are pivotally connected to the pivot ear 85 on the arm collar 82. The drive assembly 76' is provided with a tube collar 134 in lieu of the beam collar 92. The tube collar 134 has a passage therethrough slidably receiving the support tube 130. Pivot ears 135 on collar 134 are pivotally connected to the closed end of cylinder 90 so that it pivots about an axis normal to the axis $A_T$ of tube 130. The tube 130 defines spaced apart locating holes 131 therethrough along the length thereof. Collar 134 is provided with locating holes registerable with any set of locating holes 131 and a locking pin 133 is provided to extend through the holes in registration to lock the collar 134 to bue 130 at any desired position.

The support tube 133 is connected to one of the primary support beams 25 or another auxiliary support beam 48 with a connector assembly 136. The connector assembly 136 includes a beam collar 138 with a passage therethrough to slidably receive the primary support beam 25 or auxiliary support beam 48. The beam collar 138 is provided with appropriate locking holes and locking pins 139 to lock the beam collar 138 onto the support beam 25 or 48 with the locating holes therein. A cylindrical support tube 140 is affixed to the beam collar 138 and projects outwardly therefrom normal to the axis of beam collar 138. The projecting end of the support tube 140 is rotatably received in a support collar 141 provided with a locking bolt 142 to lock the support collar 141 in a rotational position around the support tube 140. The support collar 141 is affixed to a tube collar 144 so that the axis of the tube collar 144 is perpendicular to that of the support collar 141. The tube collar 144 defines a passage therethrough slidably and rotatably receiving the support tube 130. The tube collar 144 is provided with a locking bolt 145 to axially and rotationally fix tube 130 with respect to collar 144. Thus, it will be seen that the support tube 130 can be axially moved with respect to the support beam 25 or 48 mounting the backup unit 70' and can be rotatably positioned with respect to the support beam 25 or 48 mounting the pusher unit 70'. The pusher unit 70' is used similarly to pusher unit 70.

Figure 2:
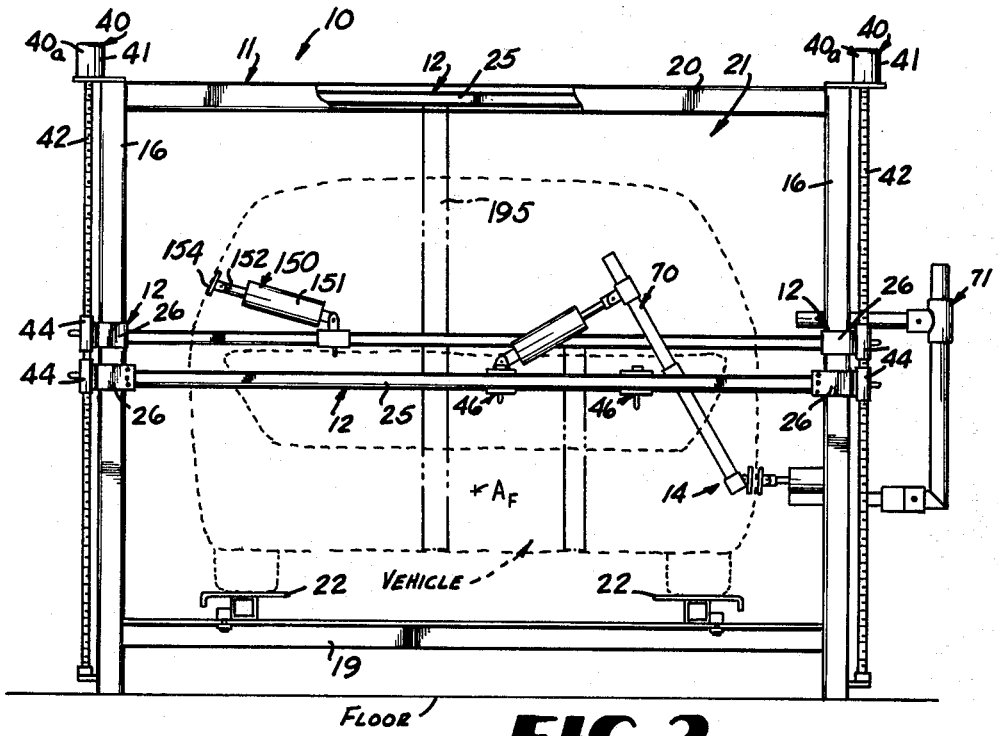
FIG. 2 is a left end elevational view of the apparatus shown in FIG. 1.
Figure 3:
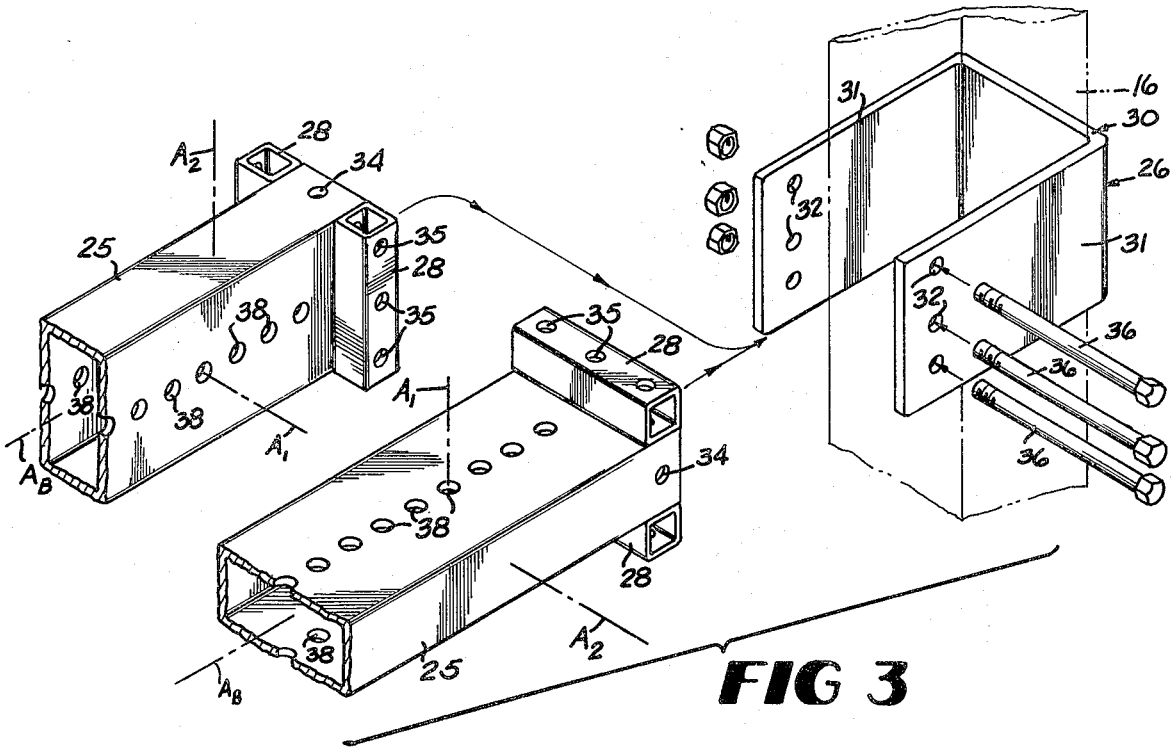
FIG. 3 is an exploded perspective view illustrating the primary support beam assemblies of the invention.

It is likewise understood that conventional straightening attachments 150 as shown in FIG. 2 may be used on frame 11 where the primary support beam assemblies 12 or auxiliary support assemblies 46 can be moved close enough to the bent body part to be straightened to permit access thereto by attachment 150. The attachment 150 would be used in conjunction with the backup unit 70 or 70' to prevent bending of the unbent body portions as the bent portions are straightened. These convention straightening attachments 150 typically include a fluid cylinder 151 which has a body working pad 154 pivotally mounted on the projecting end of its piston rod 152 as seen in FIG. 2.

To connect these attachments 150 to the primary support beam 25 or auxiliary support beam 48, beam collars 155 and 156 are provided as respectively seen in FIGS. 11 and 12. The beam collar 155 is used when the axis of the fluid cylinder 151 is to lie in a plane along the axis of the beam 25 or 48 while the collar 156 is used when the axis of the fluid cylinder 151 is to lie in a plane normal to the axis of the beam 25 or 48.

As seen in FIG. 11, the beam collar 155 has a tubular side wall 158 defining a passage 159 therethrough sized to slidably receive the support beam 25 or 48 therethrough. The side wall 158 defines a pair of aligned locking holes 160 therethrough selectively registerable with the locating holes 38 or 50 in the respective support beam 25 or 48 and a locking pin 161 is provided to extend through these registered holes to positively locate the collar 155 on the beam 25 or 48. Two sets of pivot ears 162 are mounted on side wall 158 of collar 155 and each set is provided with a pair of aligned holes 164 therethrough to allow the closed end of cylinder 151 to be pinned to ears 162 so that cylinder 151 can pivot with respect to ears 162 about axes parallel to the axis of the support beam 25 or 48 mounting the collar 155. This serves to keep the central axis of the cylinder 151 located in a plane along the axis of the support beam 25 or 48.

As seen in FIG. 12, the beam collar 156 also has a tubular side wall 158 defining a passage 159 therethrough sized to slidably receive the support beam 25 or 48 therethrough. The side wall 158 defines a pair of aligned locking holes 160 therethrough selectively registerable with the locating holes 38 or 50 in the respective support beam 25 or 48 and a locking pin 161 is provided to extend through these registered holes to positively locate the collar 155 on the beam 25 or 48. Two sets of pivot ears 165 are mounted on side wall 158 of collar 156 and each set is provided with a pair of aligned holes 164 therethrough to allow the closed end of cylinder 151 to be pinned to ears 165 so that cylinder 151 can pivot with respect to ears 165 about axes normal to the axis of the support beam 25 or 48 mounting the collar 156. This serves to keep the central axis of the cylinder 151 located in a plane normal to the axis of the support beam 25 or 48. It is to be further appreciated that both types of pivot ears 162 and 165 may be provided on the same beam collar.

It will be understood that some of the bent portions of a vehicle may be accessible only from the underside of the vehicle. To straighten these portions, an underside straightening unit 170 is provided as seen in FIGS. 1 and 13 which is surprised on the support tracks 22.

The underside straightening unit 170 includes a pair of mounting brackets 171 adapted to adjustably mount on of the auxiliary support beams 48 on top of the support tracks 22, a drive assembly 172 adapted to be adjustably positioned along the support beam 48 and a straightening assembly 174 slidably mounted on beam 48 moved by the drive assembly 172.

Each of the mounting brackets 171 includes a bottom plate 175 adapted to rest on top of the support track 22 and project over the inner edge thereof as seen in FIG. 13. A pair of upstanding attachment plates 176 are mounted on bottom plate 175 at a spacing to receive the auxiliary support beam 48 therebetween. The plates 176 are oriented normal to the longitudinal axis of support track 22. A clamping hole 178 is attached to the bottom plate 175 by bolts 179 so that clamping plate 178 fits under the inside edge of the support track 22. This allows the mounting bracket 171 to be selectively clamped to the support track 22 at any position along its length by tightening the bolts 179. The upstanding attachment plates 176 define a series of aligned sets of holes 180 therethrough on a spacing which permits at least one set of the holes 180 to be placed in registration with a set of the locating holes 50 in beam 48. A locking pin 181 is inserted through these registered holes to lock one end of beam 48 to mounting bracket 171 so that beam 48 extends transversely of tracks 22 and the vehicle being repaired. Thus the beam 48 is fixed with respect to tracks 22 by brackets 171.

The straightening assembly 176 includes a support collar 182 slidably encircling beam 48 between brackets 171. The collar 182 mounts an upstanding tubular pocket member 184 on the top thereof which extends upwardly perpendicular to beam 48. The pocket member 184 mounts a pair of pivot ears 185 on one side thereof over beam 48 for attachment to drive assembly 172. The pocket member 184 defines an upwardly opening pocket therein which removably receives a straightening post 186 therein. A plurality of straightening posts 186 may be provided of different lengths so that the height that post 186 projects above beam 48 can be changed by selecting different length posts 186.

The drive assembly 172 includes a fluid cylinder 188 with its piston rod 189 pinned to the pivot ears 185 on the straightening assembly 174. The closed end of cylinder 188 is connected to beam 48 through a mounting collar 190 slidably received around beam 48. The collar 190 is provided with a set of aligned locking holes registerable with a selected set of locating holes 50 in beam 48. A locking pin 191 is provided to extend through these registered holes to lock collar 190 in position along the length of beam 48. The cylinder 188 is pinned between pivot ears 192 on top of collar 190.

Thus, the mounting brackets 171 are locked along the length of tracks 22 with the support beam 48 in registration under the bent portion of the vehicle to be straightened. The appropriate length straightening post 186 is selected so that its upwardly projecting end from pocket member 184 will contact the bent portion of the vehicle to be straightened. With the locking pin 191 removed, both the drive assembly 172 and straightening assembly 174 are slipped along beam 48 until post 186 is adjacent the bent portion of the vehicle. The pin 191 is then inserted through collar 190 and beam 48 to lock collar 190 to beam 48. The fluid cylinder 188 is less then operated to move post 186 into contact with the bent portion of the vehicle to apply straightening forces thereto.

Backup forces in opposition to the post 186 can be applied through appropriate bracing members or other straightening units 170 operating in opposition to the aforementioned unit 170. When the straightening unit 170 is used as a backup, it may be desirable to lock the post 186 in a fixed position along the length of beam 48. To provide this feature, the support collar 182 is provided with locking holes 194 registerable with locating holes 50 in beam 48. An appropriate locking pin may be used to extend through these registered holes to lock the assembly 174 onto beam 48. The unit 170 can likewise be used to apply vertically directed forces to the vehicle with post 186 as it moves along beam 48 to iron out bends in the vehicle by carefully selecting the height of post 186.

Vertical backup for operations using the unit 170 can be supplied by brace members 195 wedged under the beam assembly 12 mounted between the top rails 20 or the support assembly 46 mounted between beam assemblies 12 along opposite sides of the frame as seen in FIG. 2.

What is claimed as invention is:

1. A straightening apparatus for use in straightening the bent portions of vehicles including:

a support frame in which the vehicle is positionable;

a pusher unit adjustably mounted on said support frame and adapted to engage the bent portion of the vehicle and apply a straightening force thereto in a first direction; and a backup unit adjustably mounted on said support frame and adapted to engage the vehicle in the vicinity of and in opposition to said pusher unit and apply backup forces to the vehicle oriented generally parallel to said straightening force and in a second direction opposite to said first direction so that the bent portion of the vehicle can be straightened back to its original shape without deformation of the unbent portions of the vehicle, said backup unit including an elongate cross member; a pair of fluid cylinders, each having an extendable piston rod; a pair of backup pads, one being mounted on each of the piston rods; a pair of support assemblies mounting said fluid cylinders on said cross member for selected movement of said fluid cylinders along said cross member toward and away from each other while maintaining the axes of said fluid cylinders parallel to each other and normal to the central axis of said cross member; and a positioning assembly adjustably mounting said cross member on said support frame for selected movement of said cross member with respect to said support frame axially along a first path parallel to the central axis of said cross member; rotationally about a second path normal to and intersecting the central axis of said cross member and parallel to the axes of said fluid cylinders, axially along and rotationally about a third path normal to said first and second paths, and axially along a fourth path parallel to said second path.

2. The straightening apparatus of claim 1 wherein said positioning assembly includes a support tube assembly; a first collar assembly slidably mounted on said cross member for slidable movement of said first collar assembly axially along said cross member and said first path and rotatably mounted on said support tube assembly for rotation of said first collar assembly and said cross member with respect to said support tube assembly about said second path, said first collar assembly further including first locking means for fixedly yet releasably connecting said first collar assembly to said cross member, and second locking means for fixedly yet releasably connecting said first collar assembly to said support tube assembly to selectively fix said first collar assembly and said cross member to said support tube assembly at any rotational position about the second path; and a connector assembly adjustably connecting said support tube assembly to said support frame.

3. The straightening apparatus of claim 2 wherein said connector assembly further includes a tube collar slidably mounted on said support tube assembly for slidable movement along said support tube assembly along said third path; a pivot member fixedly mounted on said tube collar and extending outwardly therefrom along said fourth path; and a mounting bracket adjustably mounted on said support frame, said mounting bracket slidably receiving said pivot member for axial movement along said fourth path and for rotation of said pivot member with respect to said mounting bracket about said fourth path, said mounting bracket further including pivot locking means for fixedly yet releasably connecting said mounting bracket to said pivot member to axially fix said pivot member with respect to said mounting bracket and to rotationally fix said pivot member with respect to said mounting bracket.

4. A straightening apparatus for use in straightening the bent portions of vehicles including:

a support frame in which the vehicle is positionable;

a pusher unit adjustably mounted on said support frame and adapted to engage the bent portion of the vehicle and apply a straightening force thereto in a first direction, said pusher unit including:

an elongate drive member having a longitudinal drive member axis;

a pivot assembly adjustably mounting said drive member on said support frame so that said drive member can pivot with respect to said support frame about a drive pivot axis generally normal to said drive member axis;

a working pad assembly mounted on said drive member and including a working pad adapted to engage the vehicle to apply said straightening force thereto as said drive member is pivoted about said drive pivot axis; and a drive assembly adjustably connected between said drive member and said support frame to selectively pivot said drive member about said drive pivot axis; and a backup unit adjustably mounted on said support frame and adapted to engage the vehicle in the vicinity of and in opposition to said pusher unit and apply backup forces to the vehicle oriented generally parallel to said straightening force and in a second direction opposite to said first direction so that the bent portion of the vehicle can be straightened back to its original shape without deformation of the unbent portions of the vehicle, said backup unit including:

a plurality of backup pads adapted to engage the vehicle in opposition to said pusher unit;

a plurality of backup drive assemblies, each of said back drive assemblies mounting one of said backup pads thereon and adapted to move said backup pad toward and away from the vehicle; and a mounting assembly mounting said backup drive assemblies thereon and adjustably connected to said support frame to selectively position said backup drive assemblies with respect to each other and with respect to said support frame, said mounting assembly including an elongate cross member; a plurality of support assemblies slidably mounted on said cross member, each of said support assemblies including locking means for selectively fixing said support assembly with respect to said cross member at any position axially along said cross member, each of said support assemblies mounting one of said backup drive assemblies thereon so that said backup drive assembly moves said backup pad mounted thereon along a path of movement generally normal to said cross member; and a positioning assembly adjustably mounting said cross member on said support frame, said positioning assembly including a support tube assembly; a first collar assembly slidably mounted on said cross member for slidable movement of said first collar assembly axially along said cross member and rotatably mounted on said support tube assembly for rotation of said first collar assembly and said cross member with respect to said support tube assembly about an axis of rotation generally normal to said cross member, said first collar assembly further including first locking means for fixedly yet releasably connecting said first collar assembly to said cross member, and second locking means for fixedly yet releasably connecting said first collar assembly to said support tube assembly to selectively fix said first collar assembly and said cross member to said support tube assembly at any rotational position about said axis of rotation of said first collar assembly with respect to said support tube assembly; and a connector assembly adjustably connecting said support tube assembly to said support frame, said connector assembly including a tube collar slidably mounted on said support tube assembly for slidable movement along said support tube assembly along a path generally normal to said pivot axis of said collar assembly with respect to said support tube assembly; a pivot member fixedly mounted on said tube collar and extending outwardly therefrom along an axis generally normal to the axis of movement of said tube collar with respect to said support tube assembly; and a mounting bracket adjustably mounted on said support frame, said mounting bracket slidably received around said pivot member for axial movement along said pivot member and rotatable with respect to said pivot member about the axis of said pivot member, said mounting bracket further including pivot locking means for fixedly yet releasably connecting said pivot bracket to said pivot member to axially fix said pivot bracket with respect to said pivot member and to rotationally fix said pivot bracket with respect to said pivot member.

5. The straightening apparatus of claim 4 wherein said pivot assembly of said pusher unit further includes a first pivot member adapted to be adjustably mounted on said support frame; a first arm collar pivotally mounted on said first pivot member about said drive pivot axis and defining a passage therethrough slidably receiving said drive member therein so that said first arm collar can be slidably moved along said drive member; and first locking means for fixedly yet releasably connecting said drive member to said first arm collar to selectively axially fix said first arm collar on said drive member; and wherein said drive assembly further includes a second pivot member adapted to be adjustably mounted on said support frame; a second arm collar defining a passage therethrough slidably receiving said drive member therein for axial movement of said second arm collar axially along said drive member; second locking means for fixedly yet releasably connecting said second arm collar to said drive member to selectively axially fix said second arm collar with respect to said drive member; and fluid cylinder means pivotally conneted between said second pivot member and said second arm collar to selectively pivot said drive member about said drive pivot axis as said cylinder means is extended and retracted to cause said working pad to engage the vehicle with said straightening force.

6. The straightening apparatus of claim 4 wherein said support frame includes:

a plurality of upstanding corner posts;

means connecting said corner posts to maintain said corner posts parallel to each other with said corner posts extending vertically in spaced apart positions; and a plurality of primary support beam assemblies adapted to adjustably extend between said corner posts, each of said primary support beam assemblies including an elongate primary support beam having opposed ends adapted to extend between two of said corner posts and a pair of cuff assemblies adapted to connect opposite ends of said support beam to said corner posts so that said support beam extends horizontally between said corner posts, said primary support beam having a rectilinear cross sectional shape with a major dimension in one direction along a major transverse axis and a minor dimension in the direction normal to said one direction along a minor transverse axis and including adapter means on opposite ends thereof for permitting connection between said primary support beams and said cuff assemblies so that said major transverse axis and said minor transverse axis can be alternatively vertically oriented.

7. The straightening apparatus of claim 4 wherein said support frame further includes a plurality of auxiliary support beam assemblies, each of said auxiliary support beam assemblies including an elongate auxiliary support beam and a clevis assembly removably mounting said auxiliary support beam on said primary support beam so that said auxiliary support beam is oriented perpendicular to said primary support beam.

* * * * *